US005499882A

United States Patent [19]

Waterhouse

[11] Patent Number: 5,499,882

[45] Date of Patent: Mar. 19, 1996

[54] REDUNDANT JOINT STRUCTURE AND METHOD

[76] Inventor: Robert W. Waterhouse, 249 E. Hayes Ave., Cocoa Beach, Fla. 32931

[21] Appl. No.: 293,588

[22] Filed: Aug. 22, 1994

[51] Int. Cl.[6] ..... A63H 33/10

[52] U.S. Cl. ..... 403/171; 403/176; 52/648.1; 285/181

[58] Field of Search ..... 403/176, 171; 52/648.1; 434/211, 278, 403; 285/150, 153, 181

[56] References Cited

U.S. PATENT DOCUMENTS

| | | | |
|---|---|---|---|
| Re. 33,785 | 12/1991 | Hildbrant et al. | 434/211 |
| D. 238,840 | 2/1976 | Cassina | 52/648.1 X |
| 814,367 | 3/1906 | Given . | |
| 887,008 | 5/1908 | Morton | 52/648.1 |
| 1,092,217 | 4/1914 | Hopkins . | |
| 1,965,634 | 7/1934 | Fishel . | |
| 2,922,653 | 1/1960 | O'Brien | 403/176 X |
| 3,074,203 | 1/1963 | Paksy . | |
| 3,220,152 | 11/1965 | Sturm | 52/648.1 X |
| 3,596,950 | 8/1971 | Sassenheim et al. | 403/176 X |
| 3,830,011 | 8/1974 | Ochrymowich . | |
| 4,037,861 | 7/1977 | Medney | 285/181 X |
| 4,069,832 | 1/1978 | Bingham . | |
| 4,090,798 | 5/1978 | Barton | 403/176 X |
| 4,274,222 | 6/1981 | Zahn et al. . | |
| 4,723,382 | 2/1988 | Lalvani | 52/648.1 X |
| 4,807,370 | 2/1989 | Trimble | 285/181 X |
| 5,007,220 | 4/1991 | Lalvani | 52/648.1 X |

FOREIGN PATENT DOCUMENTS

| | | | |
|---|---|---|---|
| 1575753 | 7/1969 | France | 52/648.1 |
| 596242 | 7/1959 | Italy | 52/648.1 |
| 1716022 | 2/1992 | U.S.S.R. | 52/648.1 |
| 9317192 | 9/1993 | WIPO | 52/648.1 |

*Primary Examiner*—Terry Lee Melius
*Assistant Examiner*—Christopher J. Novosad
*Attorney, Agent, or Firm*—Edward M. Livingston

[57] ABSTRACT

Redundant joints for a wide variety of redundant-joint structures have three-way plumbing elbows (1, 5, 6) with coupling sleeves (2) into which two-way plumbing elbows (9, 13, 14) are inserted and rotated to form an infinite variety of angles of joining edges or sides of structural assemblies bordered by cylindrical beams (15) inserted into sleeves (12) in the two-way elbows. The three-way elbows can have different angles for particular structures than employed for conventional plumbing uses. For other structures, the three-way elbows have the same or similar angles as those employed for conventional plumbing. Two-way elbows with a coupling sleeve at one end and a pipe-sized opposite extension employed for particular forms also can have different or the same angles as employed for conventional plumbing.

7 Claims, 5 Drawing Sheets

REDUNDANT JOINT STRUCTURE AND METHOD

BACKGROUND OF THE INVENTION

This invention relates to geometrical structures using plumbing joints and pipes that are preferably made of polyvinyl chloride (PVC) and available generally in standard and modified forms.

There are no known geometrical structures and structural methods using standard and modified forms of plumbing joints and tubular sections as structural units. There are, however, various known geometric structures using other shapes and forms of joints and tubes or rods made of different materials as building units for different types of structures.

Examples of different geometrical structures and methods in prior art include a modeling kit described in U.S. Pat. No. 4,701,131 which was granted to Hildebrandt, et al. and reissued for errors as U.S. Pat. No. Re. 33,785. The Hildebrandt, et al. patent employed nodule joints of solid rods having various polygonal cross sections. U.S. Pat. No. 4,274,222 granted to Zahn, et al. taught four-way joints of elastic tubing for a throwing toy and similar resilient devices. U.S. Pat. No. 4,069,832 granted to Bingham described tetrahedral and other forms structured with rods joined juxtaposed in tubes at corners. U.S. Pat. No. 3,830,011 granted to Ochrymowich described tubes joined with flat connectors with appendages that are inserted into ends of the tubes for joining them together. U.S. Pat. No. 3,074,203 granted to Paksy described a toy construction outfit with tubes joined by fittings of rigid plastic. U.S. Pat. No. 814,367 granted to Given in 1906 also taught toy construction with tubes joined by angular arms.

SUMMARY OF THE INVENTION

Objectives of this invention are to:

Combine new and different structural assemblies of PVC or similar materials to construct useful objects;

Employ redundancy of joints of new and known PVC plumbing units in structural puzzles as a toy; and Combine known shapes and forms of PVC plumbing units to construct useful objects.

This invention accomplishes the above and other objectives with redundant-joint structure having a plurality of three-way PVC plumbing elbows with coupling sleeves into which PVC plumbing pipes are inserted to form redundant joints to construct a variety of objects. The three-way elbows have different angles for particular structures than employed for conventional plumbing structure. For other structures, the three-way elbows have the same or similar angles as those employed for conventional plumbing. Two-way elbows with a coupling sleeve at one end and a pipe-sized opposite extension employed for particular forms also can have different or the same angles as employed for conventional plumbing.

BRIEF DESCRIPTION OF THE DRAWINGS

This invention is described by appended claims in relation to description of a preferred embodiment with reference to the following drawings which are described briefly as follows:

DESCRIPTION OF THE PREFERRED EMBODIMENTS

Figure 1:
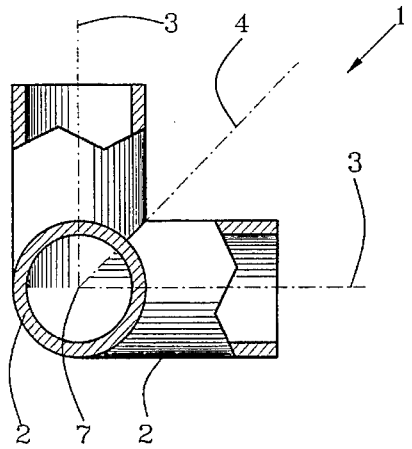
FIG. 1 is a partial cutaway elevation view of a three-sleeve pipe joint with axes of sleeves at 45 degrees from a reference axis.
Figure 2:
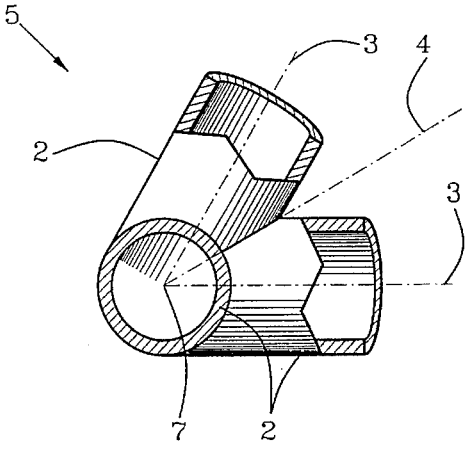
FIG. 2 is a partial cutaway elevation view of a three-sleeve pipe joint with axes of sleeves at less than 45 degrees from a reference axis.
Figure 3:
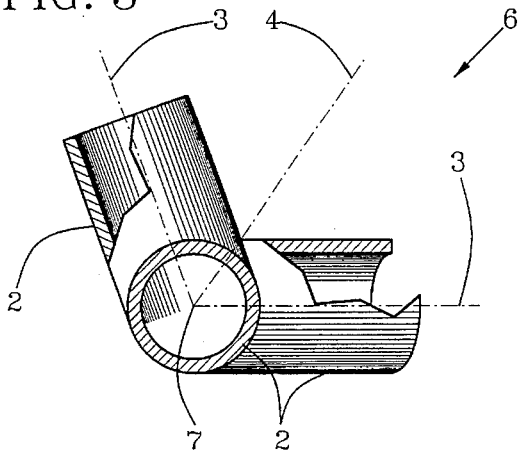
FIG. 3 is a partial cutaway elevation view of a three-sleeve pipe joint with axes of sleeves at an angle greater than 45 degrees from a reference axis.

Reference is made first to FIGS. 1–3. These are three-sleeve pipe elbows having different angles of separation of coupling sleeves from a reference axis. FIG. 1 is a 45-degree three-sleeve pipe elbow 1 having three sleeves 2 with coupling axes 3 of the three sleeves 2 having a design angle of 45 degrees of circumferential separation from a reference axis 4. The three sleeves 2 have inside peripheries that are designed for telescopic insertion and tube-coupling relationship of either cylindrical beams or second ends of two-sleeve pipe elbows which are described and shown later.

The 45-degree three-sleeve pipe elbow 1 can be described also as a three-way, 90-degree pipe elbow. However, in order to describe a symmetrical relationship of sleeves 2 with different angles of separation, three-sleeve pipe elbows are described in relationship to angles of separation of coupling axes 3 from reference axes 4 instead of from other coupling axes 3.

All of the components of this invention can be made of the same or of variously different materials. For most purposes, however, polyvinyl chloride, commonly known as PVC, is recommended. Standard PVC pipe elbows and pipe sections can be used for most applications.

In FIG. 2, a 30-degree three-sleeve pipe elbow 5 has the same three sleeves 2 with coupling axes 3 having a design angle of 30 degrees of circumferential separation from a reference axis 4. The angle of separation of the coupling axes 3 from the reference axes 4 can be less than or greater than the 45 degrees shown for the 45-degree three-sleeve pipe elbow 1 in FIG. 1. In FIG. 3, angle of separation is 60 degrees for a 60-degree, three-sleeve pipe elbow 6. The coupling axes 3 and the reference axes 4 are measured in relation to centrally intersecting elbow junctions 7.

Figure 4:
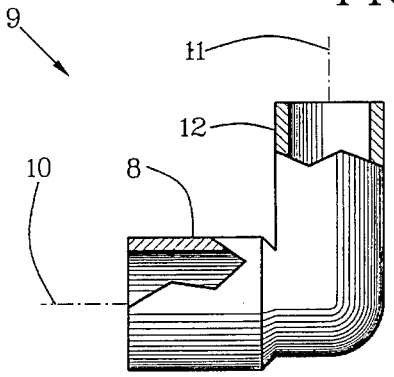
FIG. 4 is a partial cutaway elevation view of a two-sleeve pipe joint with axes of sleeves separated 90 degrees.
Figure 5:
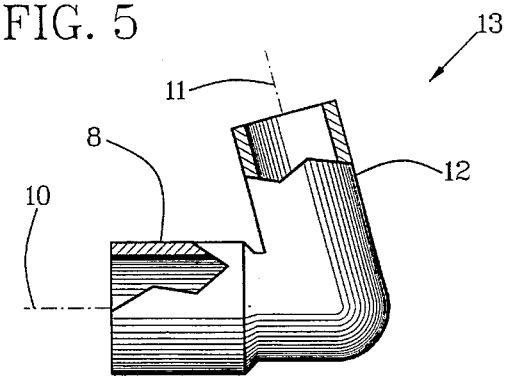
FIG. 5 is a partial cutaway elevation view of a two-sleeve pipe joint with axes of sleeves separated less than 90 degrees.
Figure 6:
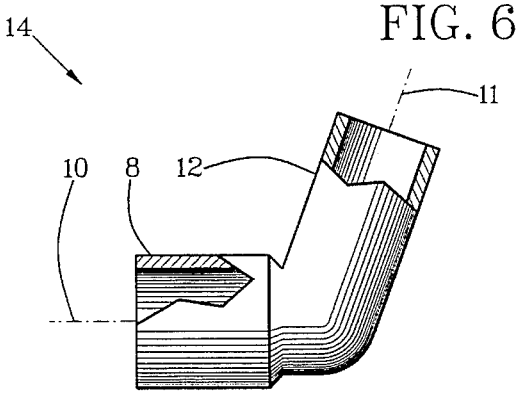
FIG. 6 is a partial cutaway elevation view of a two-sleeve pipe joint with axes of sleeves separated more than 90 degrees.

Reference is made here to FIGS. 4–6. These are two-sleeve pipe elbows having different angles of separation between sleeve axes. In FIG. 4, a first coupling sleeve 8 of a two-sleeve, 90-degree pipe elbow 9 has a coupling axis 10 that is 90 degrees from a second coupling axis 11 of a second coupling sleeve 12. The first coupling sleeve 8 has an inside periphery that is the same size as the inside periphery of the three sleeves 2 of the three-sleeve pipe elbows 1, 5 and 6 which are designed to receive the same size of cylindrical objects. In FIG. 5, a two-sleeve 60-degree pipe elbow 13 has 60 degrees of circumferential separation between coupling axes 10 and 11 of first coupling sleeve 8 and second coupling sleeve 12 respectively. In FIG. 6, a two-sleeve 120-degree pipe elbow 14 has 120 degrees of circumferential separation between coupling axes 10 and 11 of first coupling sleeve 8 and second coupling sleeve 12 respectively.

Figure 7:
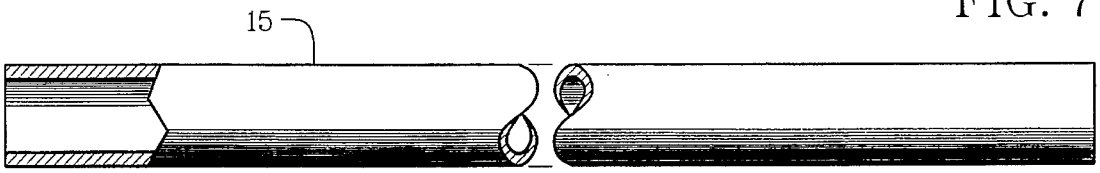
FIG. 7 is a partial cutaway side view of a cylindrical beam.

Reference is made here to FIG. 7. A cylindrical beam 15 is employed to connect two-sleeve pipe elbows 9, 13 and 14 or three-sleeve pipe elbows 1, 5 and 6. The cylindrical beam 15 can be a uniform-diameter pipe as shown. However, it functions as a beam. An outside periphery can be different between opposite ends and it need not have an inside periphery nor a uniform interior if it has an internal portion for purposes of this invention. Cylindrical describes the ends and beam describes the functional nature of the cylindrical beam 15 that joins pipe elbows 1, 5, 6, 9, 13 and 14 variously in embodiments of this invention.

Figure 8:
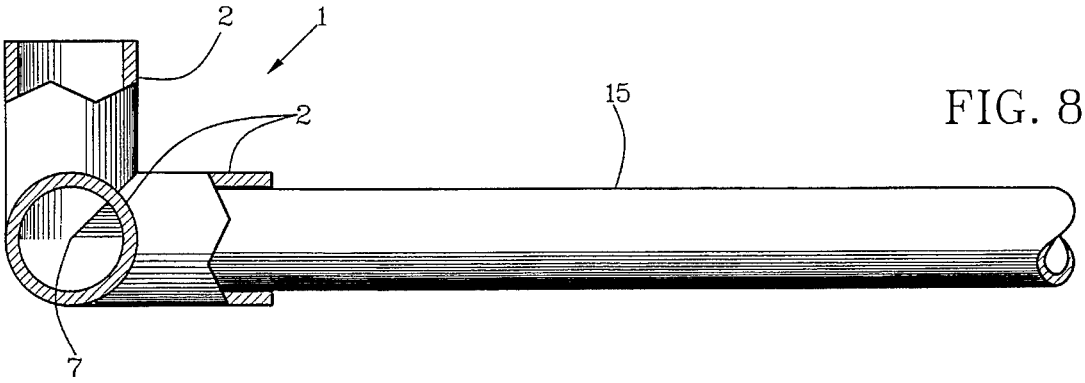
FIG. 8 is a partial cutaway side view of a cylindrical beam inserted into a three-sleeve pipe joint with 45 degrees between a reference axis and sleeve axes.

In FIG. 8, a cylindrical beam 15 is shown inserted in a sleeve 2 of a 45-degree three-sleeve pipe elbow 1 directly. This is a first type of redundant joints for a first type of redundant structures.

Figure 9:
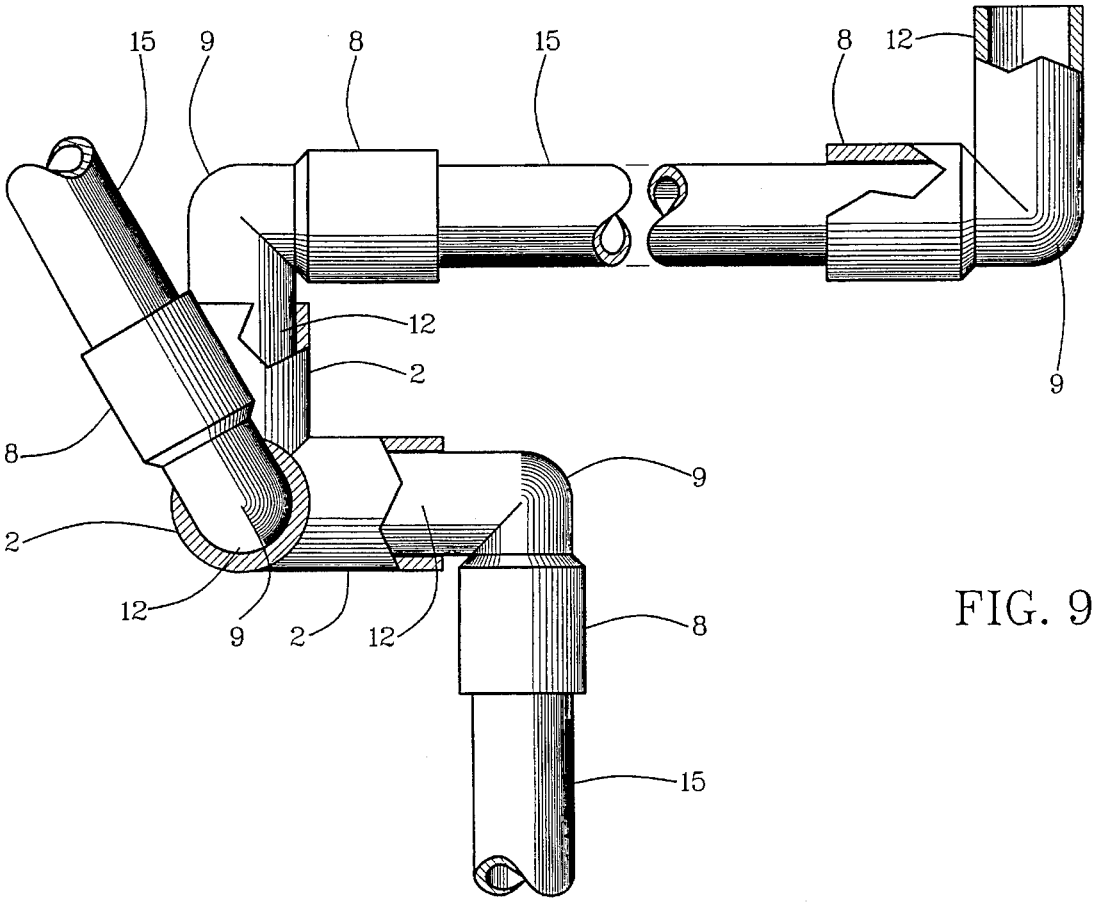
FIG. 9 is a partial cutaway side view of a 90-degree redundant joint with a two-sleeve pipe joint leading to another redundant joint.
Figure 10:
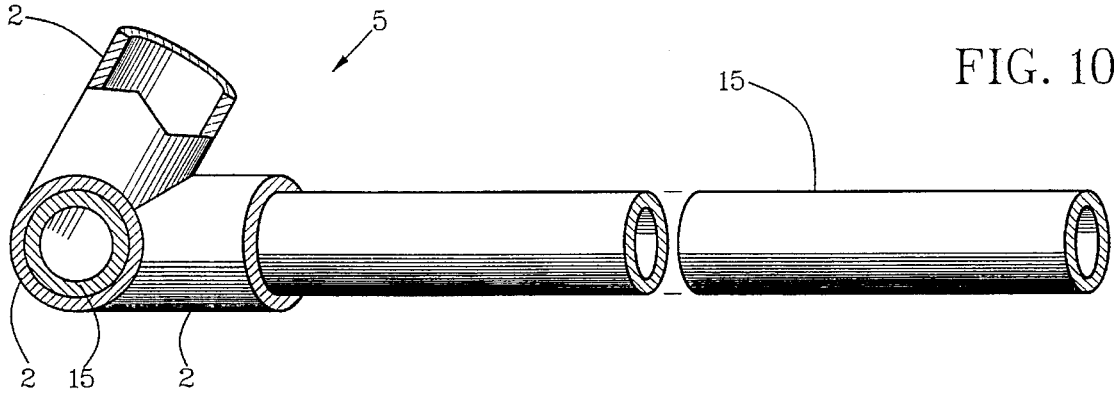
FIG. 10 is a partial cutaway side view of a cylindrical beam inserted into a three-sleeve pipe joint with less than 90 degrees between a reference axis and axes of the three sleeves.

In FIG. 9, second coupling sleeves 12 of three separate two-sleeve 90-degree pipe elbows 9 are inserted into separate sleeves 2 of a 45-degree three-sleeve pipe elbow 1. Cylindrical beams 15 are inserted into first sleeves 8 of the two-sleeve 90-degree pipe elbows 9. This is a second type of redundant joints for a second type of redundant structures. A fourth two-sleeve 90-degree pipe elbow 9 is fitted onto an opposite end of one of the cylindrical beams 15 to indicate connection with another redundant joint.

One of the two-sleeve 90-degree pipe elbows 9 is oriented to an attitude in which the first sleeve 8 and the cylindrical beam 15 inserted into it are neither parallel nor perpendicular to either sleeve 2 of the 45-degree three-sleeve pipe elbow 1. This is achieved by rotation of the sleeve 12 in the sleeve 2. In practice, none of the second sleeves 8 will be parallel or perpendicular to sleeves 2. This circumferential orientation is employed selectively to form angles between joints for construction of structural assemblies and structural objects having redundant joints with select angles between edges and faces.

Figure 11:
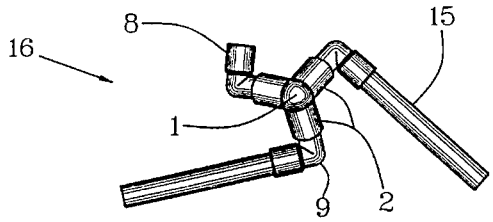
FIG. 11 is a top view of a redundant joint with a three-sleeve pipe joint having 45 degrees between sleeve and reference axes and fitted with right-angle two-sleeve pipe joints and two cylindrical beams in right-handed structure.
Figure 12:
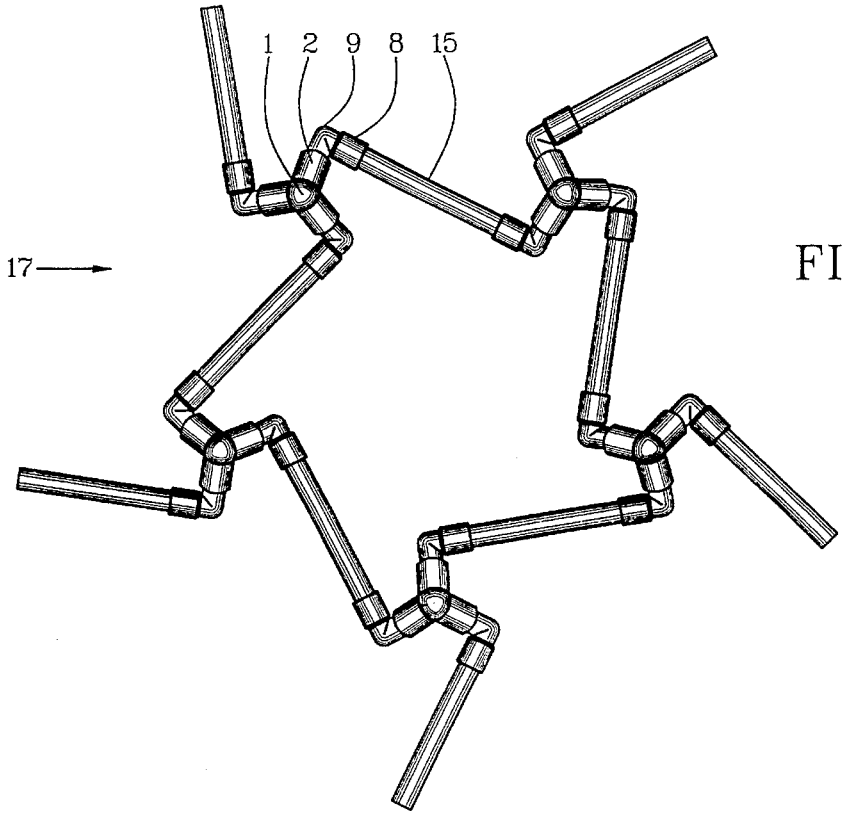
FIG. 12 is a top view of a pentagonal face of a dodecahedron using five of the redundant joints illustrated in FIG. 11.

Reference is made here to FIGS. 11–12. A pentagonal redundant joint 16 shown in FIG. 11 has pipe elbows 9 with first sleeves 8 oriented outside of sleeves 2 by rotating second sleeves 12 inside of sleeves 2, as shown and described in relation to FIG. 9, to form angles of 108 degrees between cylindrical beams 15 that are inserted into the first sleeves 8. The cylindrical beams 15 so positioned form five sides of a pentagonal structural assembly 17 shown in FIG. 12.

This pentagonal structural assembly 17 can be used for a side of a dodecahedron in which cylindrical beams 15 which are shown not inserted into second sleeves 12 at one end are inserted into like pentagonal redundant joints 16 of additional pentagonal structural assemblies 17. A cylindrical beam 15 and two pentagonal redundant joints 16 are common to each pentagonal structural assembly 17 in a dodecahedron that can be so formed.

The first sleeves 8 of the pipe elbows 9 are shown oriented with open ends clockwise from the sleeves 2 in FIGS. 11–12. These are right-handed redundant joints.

Figure 13:
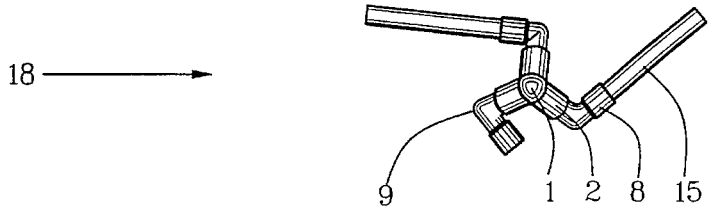
FIG. 13 is a top view of a redundant joint with a three-sleeve pipe joint having 45 degrees between sleeve and reference axes and fitted with right-angle two-sleeve pipe joints and two cylindrical beams in left-handed structure.
Figure 14:
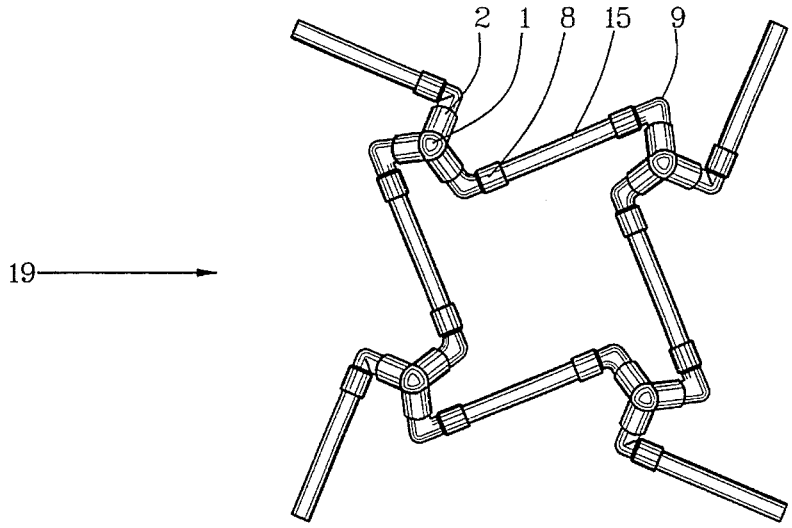
FIG. 14 is a top view of a square face of a cube using four of the redundant joints illustrated in FIG. 13.
Figure 15:
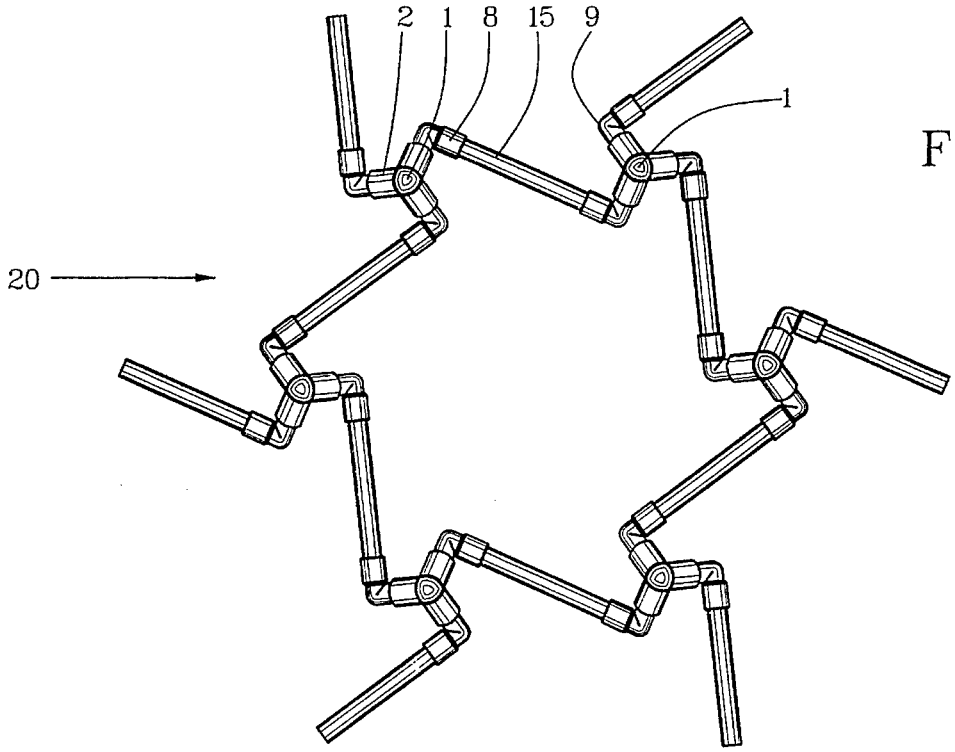
FIG. 15 is a top view of a hexagon using six of the redundant joints illustrated in FIG. 11 as a structural assembly for construction of structural objects.

Reference is made here to FIGS. 13–15. In FIG. 13, a left-handed joint 18 is shown with first sleeves 8 of the pipe elbows 9 with open ends facing counterclockwise. In FIG. 14, two each of the first sleeves 8 and cylindrical beams 15 inserted in them are oriented to 90 degrees apart for use in a square structural assembly 19 with left-handed joints 18. Remaining first sleeves 8 and cylindrical beams 15 inserted in them remain to be adjusted circumferentially to form angles as desired for use in other structural objects such as a cubical or pyramidal structure.

FIG. 15 illustrates a hexagonal structural assembly 20 with 60 degrees between cylindrical beams 15 that are inserted in first sleeves 8 of elbows 9.

The structural assembly 22 employs right-handed structural joints as described in relation to FIG. 11.

Consistent use of either left-handed joints as described in relation to FIG. 11 or right-handed joints as described in relation to FIG. 13 for an entire structural assembly 17, 19 and 20 or other structural assemblies and structural objects made from them is essential.

Analog variation of angles between cylindrical beams 15 by rotation of second sleeves 12 in sleeves 2 of elbows 1, as described in relation to FIG. 9, makes possible a wide variety of structural assemblies. Combining joints using elbows 1 with joints made with elbows having different angles of separation of coupling axes 3 from reference axes 4 such as illustrated with three-sleeve elbows 5 and 6 and two-sleeve elbows 9, 13 and 14, increases selection of structural assemblies and structural objects.

Figure 16:
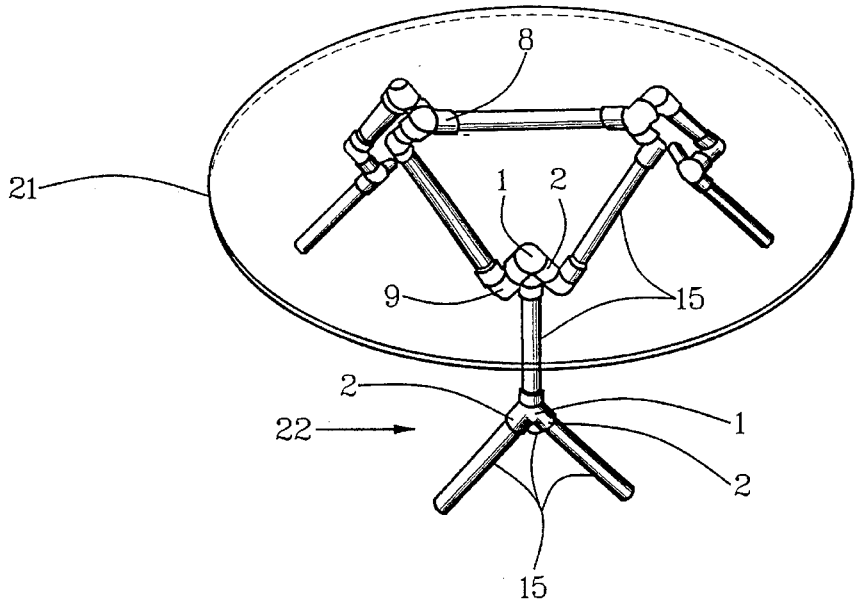
FIG. 16 is a perspective illustration of a bipod variation being used for a coffee table.
Figure 17:
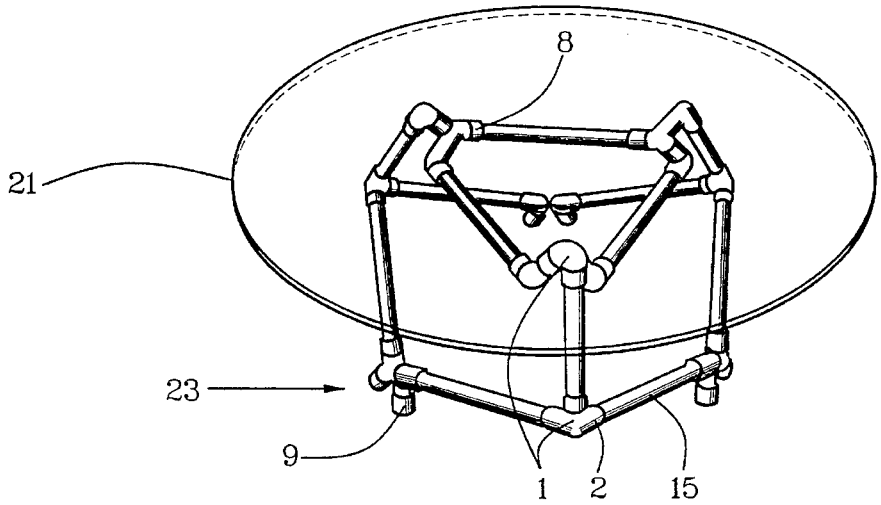
FIG. 17 is a perspective illustration of an irregular variation being used for a coffee table.
Figure 18:
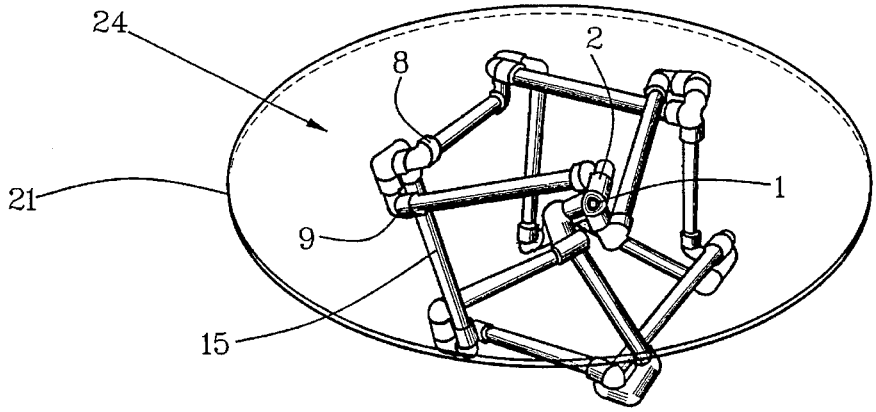
FIG. 18 is a perspective illustration of a cubic variation being used for a coffee table.

Representative of many furniture uses of this invention is a simple coffee table that is shown with a circular glass top 21 on three variations as shown in FIGS. 16–18. In FIG. 16, a cylindrical beam 15 is extended from each of two sleeves 2 of three 45-degree three-sleeve pipe elbows 1 to form three sets of bipod legs 22. In FIG. 17, angle legs 23 are formed by two-sleeve 90-degree pipe elbows 9 at ends of horizontal cylindrical beams 15. In FIG. 18, a cubic structure 24 is formed by completing a plurality of structural assemblies 19 shown in FIG. 14 and setting the circular glass top 21 on it.

A new and useful redundant-joint structure and method having been described, all such modifications, adaptations, substitutions of equivalents, combinations of parts, applications and forms thereof as described by the following claims are included in this invention.

LIST OF COMPONENTS (For Convenience Of The Examiner)

1. 45-degree three-sleeve pipe elbow
2. sleeves
3. coupling axes
4. reference axis
5. 30-degree three-sleeve pipe elbow
6. 60-degree three-sleeve pipe elbow
7. centrally intersecting elbow junctions
8. first coupling sleeve
9. two-sleeve 90-degree pipe elbow
10. coupling axis of first coupling sleeve
11. second coupling axis
12. second coupling sleeve
13. two-sleeve 60-degree pipe elbow
14. two-sleeve 120-degree pipe elbow
15. cylindrical beam
16. pentagonal redundant joint
17. pentagonal structural assembly
18. left-handed joint
19. square structural assembly
20. hexagonal structural assembly
21. glass top
22. bipod legs
23. angle legs
24. cubic structure

Having thus described my invention, I claim:

1. A redundant-joint structure comprising:

a plurality of three-sleeve pipe elbows;

inside peripheries of three sleeves of the plurality of three-sleeve pipe elbows having equal design sizes;

reference axes centrally intersecting elbow junctions from which the three sleeves of the pipe elbows are extended;

coupling axes of the three coupling sleeves having a design angle of forty-five degrees of circumferential separation from the reference axes;

a plurality of two-sleeve pipe elbows having ninety degrees of separation between a first coupling sleeve and a second coupling sleeve of each of the plurality of two-sleeve pipe elbows;

a plurality of cylindrical beams having equal outside peripheries that are equal at opposite ends of each of the plurality of cylindrical beams;

the first coupling sleeve of each of the plurality of two-sleeve pipe elbows has an inside periphery in which an outside periphery of an end of one of the plurality of cylindrical beams is positioned snugly;

the second coupling sleeve of each of the plurality of two-sleeve pipe elbows has an outside periphery positioned snugly in the inside periphery of a separate one of the three sleeves of the plurality of three-sleeve pipe elbows respectively; and a structural assembly of the plurality of three-sleeve pipe elbows, the plurality of two-sleeve pipe elbows and the plurality of cylindrical beams.

2. A redundant-joint structure as described in claim 1 wherein:

the plurality of three-sleeve pipe elbows is five;

the plurality of cylindrical beams is five;

lengths of the cylindrical beams are equal;

the plurality of two-sleeve pipe elbows is fifteen;

first coupling sleeves of the plurality of two-sleeve pipe elbows are positioned on ends of the plurality of cylindrical beams respectively;

second coupling sleeves of the plurality of two-sleeve pipe elbows are positioned in inside peripheries of sleeves of the three-sleeve pipe elbows respectively; and the structural assembly is pentagonal.

3. A redundant-joint structure as described in claim 1 wherein:

the plurality of three-sleeve pipe elbows is eight;

the plurality of cylindrical beams is twelve;

lengths of the cylindrical beams are equal;

the plurality of two-sleeve pipe elbows is twenty four;

first coupling sleeves of the plurality of two-sleeve pipe elbows are positioned on ends of the plurality of cylindrical beams respectively;

second coupling sleeves of the plurality of two-sleeve pipe elbows are positioned in inside peripheries of the sleeves of the three-sleeve pipe elbows of six square faces having structural assemblies of common redundant joints of three-sleeve pipe elbows, two-sleeve pipe elbows and cylindrical beams respectively; and the structural assembly is cubical.

4. A redundant-joint structure as described in claim 1 wherein:

the structural assembly is a face of a structural object having a design plurality of faces;

the design plurality of faces have redundant joints on the design plurality of corners of the design plurality of faces of the structural object;

the redundant joints have three-sleeve pipe elbows with second coupling sleeves of three two-sleeve pipe elbows inserted into sleeves of the three-sleeve pipe elbows on the design plurality of corners of the design plurality of faces of the structural object; and the faces of the structural object have a design plurality of redundant joints that are common to adjacent faces of the structural object.

5. A redundant-joint structure as described in claim 1 wherein:

cylindrical beams and redundant joints on opposite ends of the cylindrical beam on a side of a face of the structural object are common to at least one adjacent face of the structural object.

6. A method for constructing a redundant-joint structure comprising:

a plurality of three-sleeve pipe elbows;

the three-sleeve pipe elbows having three coupling sleeves with inside peripheries that are designed to receive a design size of cylindrical beams telescopically in tube-coupling relationship;

reference axes centrally intersecting elbow junctions from which the three coupling sleeves are extended;

coupling axes of the three coupling sleeves having a design angle of circumferential separation from the reference axes;

a plurality of cylindrical beams having design lengths and outside peripheries of opposite ends that fit telescopically in the inside peripheries of the coupling sleeves;

a plurality of two-sleeve pipe elbows having first coupling sleeves and second coupling sleeves;

the first coupling sleeves of the plurality of two-sleeve pipe elbows having inside peripheries designed to receive an end of a design size of cylindrical beams telescopically in tube-coupling relationship;

the second coupling sleeves of the plurality of two-sleeve pipe elbows having outside peripheries designed to fit telescopically in inside peripheries of coupling sleeves of the plurality of three-sleeve pipe elbows;

a design angle of circumferential separation of the first coupling sleeves from the second coupling sleeves of the plurality of two-sleeve pipe elbows;

design angle of circumferential separation of the coupling axes from the reference axes of the plurality of three-sleeve pipe elbows is forty-five degrees;

design angle of circumferential separation of the first coupling sleeves from the second coupling sleeves of the plurality of two-sleeve pipe elbows is ninety degrees;

the structural assembly is a face of a structural object having a design plurality of faces;

the design plurality of faces have redundant joints on the design plurality of corners of the design plurality of faces of the structural object;

the redundant joints have three-sleeve pipe elbows with second ends of three two-sleeve pipe elbows inserted into sleeves of the three-sleeve pipe elbows on the design plurality of corners of the design plurality of faces of the structural object; and the faces of the structural object have a design plurality of redundant joints that are common to adjacent faces of the structural object;

the method comprising:

assembling a plurality of redundant joints having second sleeves of two-sleeve pipe elbows inserted in the three sleeves of a plurality of three-sleeve pipe elbows that is equal to a design plurality of redundant joints of the design structural object;

orienting the first sleeves of the two-sleeve pipe elbows to a clockwise direction of extension relative to a view from the elbow junctions for right-handed structural assemblies;

inserting cylindrical beams in facing adjacent first sleeves for a design plurality of sides of faces of the design structural object while simultaneously orienting the two-sleeve pipe elbows in either direction as necessary to achieve desired angles of the cylindrical beams from the redundant joints having cylindrical beams inserted in two of the first joints of the two-sleeve pipe elbows extending clockwise from two of the three sleeves of the three-sleeve pipe elbows and remaining first joints of the two-sleeve pipe elbows remaining vacant; and joining the design plurality of sides of faces of the design structural object by inserting cylindrical beams in the remaining first joints of the two-sleeve pipe elbows while simultaneously orienting the remaining first joints of the two-sleeve pipe elbows as necessary for constructing the design plurality of faces of the design structural object with redundant joints and common cylindrical beams comprising common sides of the faces and edges of the design structural object.

7. A method as described in claim 6 wherein:

the first sleeves of the two-sleeve pipe elbows are oriented to a counterclockwise direction of extension relative to a view from the elbow junctions for left-handed structural assemblies.

* * * * *